US012344963B2

(12) United States Patent
Yin

(10) Patent No.: US 12,344,963 B2
(45) Date of Patent: Jul. 1, 2025

(54) METHOD FOR PRODUCING YARN FROM SUGARCANE

(71) Applicant: JIN JIANG AN RUN TEXTILE CO., LTD., Quanzhou (CN)

(72) Inventor: Honghui Yin, Zhoukou (CN)

(73) Assignee: JIN JIANG AN RUN TEXTILE CO., LTD., Quanzhou (CN)

( * ) Notice: Subject to any disclaimer, the term of this patent is extended or adjusted under 35 U.S.C. 154(b) by 0 days.

(21) Appl. No.: 19/021,538

(22) Filed: Jan. 15, 2025

(65) Prior Publication Data

US 2025/0154692 A1 May 15, 2025

Related U.S. Application Data

(63) Continuation of application No. PCT/CN2023/123295, filed on Oct. 8, 2023.

(30) Foreign Application Priority Data

Oct. 10, 2022 (CN) ..... 202211236174.9

(51) Int. Cl.
*D02G 3/04* (2006.01)
*D01C 1/00* (2006.01)

(52) U.S. Cl.
CPC ..... *D02G 3/042* (2013.01); *D01C 1/00* (2013.01); *D10B 2201/01* (2013.01); *D10B 2401/062* (2013.01)

(58) Field of Classification Search
CPC ..... D02G 3/042; D01C 1/00; D10B 2201/01; D10B 2401/062
See application file for complete search history.

(56) References Cited

FOREIGN PATENT DOCUMENTS

| | | | |
|---|---|---|---|
| BR | PI0705436 A2 | | 6/2009 |
| CN | 101392467 B | | 3/2009 |
| CN | 102504460 | * | 6/2012 |
| CN | 102504460 B | | 6/2012 |
| CN | 103450363 B | | 12/2013 |
| CN | 104032380 B | | 9/2014 |
| CN | 104213447 | * | 12/2014 |
| CN | 104213447 B | | 12/2014 |
| CN | 107083687 A | | 8/2017 |
| CN | 109575145 A | | 4/2019 |
| CN | 114645332 A | | 6/2022 |
| CN | 115506061 A | | 12/2022 |

OTHER PUBLICATIONS

Mahmud et al. Sugarcane bagasse—A source of cellulosic fiber for diverse applications. Heliyon, vol. 7, Issue 8, Aug. 2021, e07771 https://www.sciencedirect.com/science/article/pii/S2405844021018740?via%3Dihub.*

Costa et al. Use of sugar cane straw as a source of cellulose for textile fiber production, Industrial Crops and Products, vol. 42, Mar. 2013, pp. 189-194 https://www.sciencedirect.com/science/article/pii/S0926669012002932.*

Michel et al. Preparation of Cellulosic Fibers from Sugarcane for Textile Use Hindawi Publishing Corporation Conference Papers in Materials Science vol. 2013, Article ID 651787, 6 pages https://onlinelibrary.wiley.com/doi/10.1155/2013/651787.*

Xiao Bo, Ma Longlong, Li Jianfen, Zhu Yuezhao, "Metallurgical Industry Press", <<BiomassThermochemical Conversion Technology>> Jun. 30, 2016 (Jun. 30, 2016), p. 105.

Mei Ziqiang, "China Textile Press", <<Textile Dictionary>> Jan. 31, 2007 (Jan. 31, 2007), p. 691.

Guo Yaoting, "Petroleum University Press", <<Organic Chemistry>> Aug. 31, 1996 (Aug. 31, 1996), pp. 348-351.

* cited by examiner

*Primary Examiner* — Amina S Khan
(74) *Attorney, Agent, or Firm* — Birchwood IP

(57) ABSTRACT

A method for producing a yarn from sugarcane is provided, which includes at least the following steps: S1: separating bagasse and a sugarcane juice produced by pressing sugarcane, and dividing the bagasse into two parts, one part being used for extracting natural fibers from the sugarcane and the other part being used for extracting starch fibers from the sugarcane; 2: extracting natural fibers from the sugarcane to obtain a raw material for preparing long fibers; S3: extracting starch fibers from the sugarcane to obtain a raw material for preparing short fibers; S4: softening the raw material of long fibers and the raw material of short fibers, through matched application of corresponding processing methods, the bagasse left after the processing of sugarcane products can be conveniently reused, and the reused bagasse is treated for yarn preparation, such that the output of waste materials during the production process is reduced.

5 Claims, No Drawings

METHOD FOR PRODUCING YARN FROM SUGARCANE

CROSS-REFERENCE TO RELATED APPLICATIONS

This application is a continuation of International Application No. PCT/CN2023/123295, filed on Oct. 8, 2023, which claims priority to Chinese Patent Application No. 202211236174.9, filed with the China National Intellectual Property Administration on Oct. 10, 2022. Both of which are hereby incorporated by reference in their entireties.

TECHNICAL FIELD

The present disclosure relates to the field of preparation of a yarn from sugarcane technologies, and in particular, to a method for producing a yarn from sugarcane.

BACKGROUND

Sugarcane is an annual or perennial tropical and subtropical Poaceae plant, belonging to the C4 crop. Its cylindrical stem is upright, tillering, clustered, and has nodes with buds on the nodes. Besides absorbing some minerals from the soil, sugarcane has a strong ability to absorb carbon dioxide and a high utilization rate. Its daily absorption of carbon dioxide is more than twice that of rice, and it can absorb low concentrations of carbon dioxide. Under normal circumstances, the concentration of carbon dioxide in the air is around 300 ppm. When the concentration is less than 50 ppm, rice cannot absorb the surrounding carbon dioxide. But sugarcane can still maintain normal absorption even when the surrounding carbon dioxide concentration is less than 5 ppm to 10 ppm. Therefore, in addition to absorbing the carbon dioxide exhaled by itself (in an absence of photosynthesis), sugarcane can also absorb a large amount of surrounding carbon dioxide to meet its own needs and release oxygen.

Sugarcane also has strong resistance to some harmful gases to the human body, such as hydrogen fluoride, chlorine gas, and hydrogen chloride. Even it can turn waste into treasure, converting the wastewater from paper mills into its own fertilizer, thereby reducing the pollution caused by the wastewater to the environment and contributing to sustainable ecological development. Through this technology, the textile industry can fully unleash the power of technological innovation in the arduous century long challenge of carbon peak and carbon neutrality, thereby achieving a goal of "carbon peak and carbon neutrality".

During the processing of corresponding products of sugarcane, sugarcane juice is mostly extracted, and sugarcane juice is used for sucrose extraction. After this processing, a large amount of bagasse waste is often produced, and there are many natural fibers and starch in the bagasse, which meets conditions for fiber extraction to form long fibers and short fibers.

However, the existing processing methods often lack corresponding method for producing yarn, resulting in a lack of application of bagasse for producing yarn.

SUMMARY

The purpose of the present disclosure is to provide a method for producing a yarn from sugarcane to solve problems raised in the background technology.

To achieve the above objectives, the present disclosure provides the following technical solution: a method for producing a yarn from sugarcane, including at least the following steps:

S1: separating bagasse and a sugarcane juice produced by pressing sugarcane, and dividing the bagasse into two parts, one part being used for extracting natural fibers from the sugarcane and the other part being used for extracting starch fibers from the sugarcane;

S2: extracting natural fibers from the sugarcane to obtain a raw material for preparing long fibers;

S3: extracting starch fibers from the sugarcane to obtain a raw material for preparing short fibers;

S4: softening a raw material of long fibers and a raw material of short fibers;

S5: performing a decolorize treatment on the raw material of long fibers and the raw material of short fibers that have been softened to render fiber color tend towards white for a subsequent dyeing process;

S6: twisting the raw material of long fibers processed in S5 to form the long fibers;

S7: twisting the raw material of short fibers processed in S5 to form the short fibers;

S8: mixing the long fibers and the short fibers to prepare a bobbin yarn with a ring spinning manner;

S9: performing oxidization and desizing of the bobbin yarn, and pre-shrinking of the bobbin yarn at 130° C., adding a refining agent during a pre-shrinking process to remove impurities;

S10: performing a causticizing treatment on the bobbin yarn to render the bobbin yarn have strong swelling to improve flexibility and reduce stiffness;

S11: performing an enzymatic treatment of the bobbin yarn to improve a finish degree of raw materials, reduce a bending resistance and a stiffness of the fibers and further improve a hand feel;

S12: reducing and washing the bobbin yarn to control a pH to be 4.5-5.5;

S13: drying the bobbin yarn after restoration and washing;

S14: stretching and shaping dried bobbin yarn and stacking.

In some embodiments of the present disclosure, S2 includes the following steps:

pre acid leaching separated bagasse with sulfuric acid having a concentration of 0.4-1.4 ml/L, at a temperature of 30-60° C., and a soaking time of 40-75 minutes;

adding laccase in a mass ratio of 1:0.2-0.3 to the bagasse after acid leaching, and hydrolyzing for 2-6 hours at a temperature of 60-75° C. to obtain the natural fibers;

washing hydrolyzed natural fibers with water;

performing an alkaline reduction treatment on the natural fibers with NaOH 5-12 g/L and $H_2O_2$ 5-10 g/L to render a pH value of the natural fibers to be 6.5-7.5.

In some embodiments of the present disclosure, S3 includes the following steps:

soaking the bagasse in a NaOH solution with a pH of 9-11 at 25-60° C. for 1-1.25 hours to obtain a solution containing starch;

filtering the solution containing starch through 300 mesh and allow a filtrate to settle naturally for 1.2-1.5 hours to obtain a starch emulsion;

washing the starch emulsion with distilled water for 6-7 consecutive times, then decolorizing and drying to obtain a sugarcane starch;

soaking the sugarcane starch in a NaOH solution with a mass percentage of 0.6%-1.75% at 24-47° C. for 32-35 minutes, and then filtering an extracted solution through 300 mesh to obtain a filter residue;

washing the filter residue twice with anhydrous ethanol and twice with acetone;

drying in a constant temperature drying oven to obtain sugarcane starch cellulose.

In some embodiments of the present disclosure, S8 includes the following steps:

mixing the long fibers and the short fibers to form a coarse yarn;

feeding the coarse yarn into a stretching device for stretching;

outputting strands of fiber by a front roller after stretching;

twisting by steel rings and steel wire coils, winding onto a tube that rotates with a high-speed spindle to form the bobbin yarn.

In some embodiments of the present disclosure, S4 includes the following steps:

preparing a softener according to surfactant TX-10, 7-12%; sulfonic acid, 6-9%; surfactant peregal O, 4-7.5%; surfactant AES, 5.6-10.3%; surfactant 6501, 7.2-12%; subtilase enzyme, 52-72%; dispersive chelating agent, 1 g/L-2 g/L; NaOH 6g/L-10g/L;

spraying the softener on the raw material of long fibers and the raw material of short fibers;

stacking the raw material of long fibers and raw material of short fibers after being sprayed at a temperature of 20° C.-25° C. for 16-25 hours.

Compared with the existing technology, the beneficial effects of the present disclosure are as following.

In the present disclosure, through matched application of corresponding processing methods, the bagasse left after the processing of sugarcane products can be conveniently reused, and the reused bagasse is treated for yarn preparation, such that the output of waste materials during the production process is reduced, and the economic efficiency of cyclic utilization is improved, thereby effectively weakening a dependence of footwear and apparel industry on non-renewable energy, and better achieving a need for carbon neutrality.

DESCRIPTION OF EMBODIMENTS

Example 1

A method for producing a yarn from sugarcane, including at least the following steps:

S1: separating bagasse and a sugarcane juice produced by pressing sugarcane, and dividing the bagasse into two parts, one part being used for extracting natural fibers from the sugarcane and the other part being used for extracting starch fibers from the sugarcane;

S2: extracting natural fibers from the sugarcane to obtain a raw material for preparing long fibers;

pre acid leaching separated bagasse with sulfuric acid having a concentration of 0.4 ml/L, at a temperature of 30° C., and a soaking time of 40 minutes;

adding laccase in a mass ratio of 1:0.2 to bagasse after acid leaching, and hydrolyzing for 2 hours at a temperature of 60° C. to obtain the natural fibers;

washing hydrolyzed natural fibers with water;

performing an alkaline reduction treatment on the natural fibers with NaOH 5 g/L and $H_2O_2$ 5 g/L to render a pH value of the natural fibers to be 6.5-7.5.

S3: extracting starch fibers from the sugarcane to obtain a raw material for preparing short fibers;

soaking the bagasse in a NaOH solution with a pH of 9-11 at 25-60° C. for 1 hour to obtain a solution containing starch;

filtering the solution containing starch through 300 mesh and allow a filtrate to settle naturally for 1.2 hours to obtain a starch emulsion;

washing the starch emulsion with distilled water for 6 consecutive times, then decolorizing and drying to obtain a sugarcane starch;

soaking the sugarcane starch in a NaOH solution with a mass percentage of 0.6% at 24° C. for 32 minutes, and then filtering an extracted solution through 300 mesh to obtain a filter residue;

washing the filter residue twice with anhydrous ethanol and twice with acetone;

drying in a constant temperature drying oven to obtain sugarcane starch cellulose;

S4: softening a raw material of long fibers and a raw material of short fibers;

preparing a softener according to surfactant TX-10, 7%; sulfonic acid, 6%; surfactant peregal O, 4%; surfactant AES, 5.6%; surfactant 6501, 7.2%; subtilase enzyme, 52%; dispersive chelating agent, 1 g/L; NaOH 6 g/L;

spraying the softener on the raw material of long fibers and the raw material of short fibers;

stacking the raw material of long fibers and raw material of short fibers after being sprayed at a temperature of 20° C. for 16 hours;

S5: performing a decolorize treatment on the raw material of long fibers and the raw material of short fibers that have been softened to render fiber color tend towards white for a subsequent dyeing process;

S6: twisting the raw material of long fibers processed in S5 to form the long fibers;

S7: twisting the raw material of short fibers processed in S5 to form the short fibers;

S8: mixing the long fibers and the short fibers to prepare a bobbin yarn with a ring spinning manner;

mixing the long fibers and the short fibers to form a coarse yarn;

feeding the coarse yarn into a stretching device for stretching;

outputting strands of fiber by a front roller after stretching;

twisting by steel rings and steel wire coils, winding onto a tube that rotates with a high-speed spindle to form the bobbin yarn;

S9: performing oxidization and desizing of the bobbin yarn, and pre-shrinking of the bobbin yarn at 130° C., adding a refining agent during a pre-shrinking process to remove impurities;

S10: performing a causticizing treatment on the bobbin yarn to render the bobbin yarn have strong swelling to improve flexibility and reduce stiffness;

S11: performing an enzymatic treatment of the bobbin yarn to improve a finish degree of raw materials, reduce a bending resistance and a stiffness of fibers and further improve a hand feel;

S12: reducing and washing the bobbin yarn to control a pH to be 4.5-5.5;

S13: drying the bobbin yarn after restoration and washing;

S14: stretching and shaping dried bobbin yarn and stacking.

Example 2

A method for producing sugarcane yarn, including at least the following steps:

S1: separating bagasse and a sugarcane juice produced by pressing sugarcane, and dividing the bagasse into two parts, one part being used for extracting natural fibers from the sugarcane and the other part being used for extracting starch fibers from the sugarcane;

S2: extracting natural fibers from the sugarcane to obtain a raw material for preparing long fibers;

pre acid leaching separated bagasse with sulfuric acid having a concentration of 1.4 ml/L, at a temperature of 60° C., and a soaking time of 75 minutes;

adding laccase in a mass ratio of 1:0.3 to bagasse after acid leaching, and hydrolyzing for 6 hours at a temperature of 75° C. to obtain the natural fibers;

washing hydrolyzed natural fibers with water;

performing an alkaline reduction treatment on the natural fibers with NaOH 12 g/L and $H_2O_2$ 10 g/L to render a pH value of the natural fibers to be 6.5-7.5;

S3: extracting starch fibers from the sugarcane to obtain a raw material for preparing short fibers;

soaking the bagasse in a NaOH solution with a pH of 11 at 60° C. for 1.25 hours to obtain a solution containing starch;

filtering the solution containing starch through 300 mesh and allow a filtrate to settle naturally for 1.5 hours to obtain a starch emulsion;

washing the starch emulsion with distilled water for 7 consecutive times, then decolorizing and drying to obtain a sugarcane starch;

soaking the sugarcane starch in a NaOH solution with a mass percentage of 1.75% at 47° C. for 32-35 minutes, and then filtering an extracted solution through 300 mesh to obtain a filter residue;

washing the filter residue twice with anhydrous ethanol and twice with acetone;

drying in a constant temperature drying oven to obtain sugarcane starch cellulose;

S4: softening a raw material of long fibers and a raw material of short fibers;

preparing a softener according to surfactant TX-10, 12%; sulfonic acid, 9%; surfactant peregal O, 7.5%; surfactant AES, 10.3%; surfactant 6501, 12%; subtilase enzyme, 72%; dispersive chelating agent, 2 g/L; NaOH 10 g/L;

spraying the softener on the raw material of long fibers and the raw material of short fibers;

stacking the raw material of long fibers and raw material of short fibers after being sprayed at a temperature of 25° C. for 25 hours;

S5: performing a decolorize treatment on the raw material of long fibers and the raw material of short fibers that have been softened to render fiber color tend towards white for a subsequent dyeing process;

S6: twisting the raw material of long fibers processed in S5 to form the long fibers;

S7: twisting the raw material of short fibers processed in S5 to form the short fibers;

S8: mixing the long fibers and the short fibers to prepare a bobbin yarn with a ring spinning manner;

mixing the long fibers and the short fibers to form a coarse yarn;

feeding the coarse yarn into a stretching device for stretching;

outputting strands of fiber by a front roller after stretching;

twisting by steel rings and steel wire coils, winding onto a tube that rotates with a high-speed spindle to form the bobbin yarn.

S9: performing oxidization and desizing of the bobbin yarn, and pre-shrinking of the bobbin yarn at 130° C., adding a refining agent during a pre-shrinking process to remove impurities;

S10: performing a causticizing treatment on the bobbin yarn to render the bobbin yarn have strong swelling to improve flexibility and reduce stiffness;

S11: performing an enzymatic treatment of the bobbin yarn to improve a finish degree of the raw materials, reduce a bending resistance and a stiffness of the fibers and further improve a hand feel;

S12: reducing and washing the bobbin yarn to control a pH to be 4.5-5.5;

S13: drying the bobbin yarn after restoration and washing;

S14: stretching and shaping dried bobbin yarn and stacking.

For those skilled in the art, it is obvious that the present disclosure is not limited to details of the exemplary embodiments described above and can be implemented in other specific forms without departing from the spirit or essential features of the present disclosure. Therefore, from any point of view, the embodiments should be regarded as exemplary and non-limiting, and the scope of the present disclosure is limited by the appended claims rather than the above description. Therefore, it is intended to encompass all variations falling within the meaning and scope of equivalent elements of the claims within the scope of the present disclosure.

What is claimed is:

1. A method for producing a yarn from sugarcane, comprising the following steps:

S1: separating bagasse and a sugarcane juice produced by pressing sugarcane, and dividing the bagasse into two parts, one part being used for extracting natural fibers from the sugarcane and the other part being used for extracting starch fibers from the sugarcane;

S2: extracting natural fibers from the sugarcane to obtain a raw material for preparing first fibers;

S3: extracting starch fibers from the sugarcane to obtain a raw material for preparing second fibers;

S4: softening a raw material of first fibers and a raw material of second fibers;

S5: performing a decolorizing treatment on the raw material of first fibers and the raw material of second fibers that have been softened to render fiber color to be white for a subsequent dyeing process, wherein the decolorizing treatment comprises rinsing softened first and second fibers with warm water of 40-50° C., immersing the first and second fibers in a solution containing 5 g/L of $H_2O_2$, adjusting a pH of the solution with NaOH to be 10.5, adding 3g/L sodium silicate, with a bath ratio of 1:15, raising a temperature to 90° C., keeping the temperature for 75 minutes and stirring to uniform decolorization;

S6: twisting the raw material of first fibers processed in S5 to form the first fibers;

S7: twisting the raw material of second fibers processed in S5 to form the second fibers;

S8: mixing the first fibers and the second fibers to prepare a bobbin yarn;

S9: performing oxidization and desizing of the bobbin yarn, and pre-shrinking of the bobbin yarn at 130° C., wherein a refining agent is added during a pre-shrinking process to remove impurities, wherein the refining agent is 10 g/L $H_2O_2$. S10: performing a causticizing treatment on the bobbin yarn to swell the bobbin yarn to improve flexibility and reduce stiffness;

S11: performing an enzymatic treatment of the bobbin yarn to reduce a bending resistance and a stiffness of the fibers;

S12: washing the bobbin yarn to control a pH to be 4.5-5.5, wherein the washing comprises dissolving a reducing agent $Na_2S_2O_4$ having a concentration of 0.5-3 g/L into water to form a solution, adding acetic acid to adjust a pH of the solution to 4.5-5.5, immersing the bobbin yarn in the solution with a bath ratio, defined as a material to solution ratio of 1:10-1:15, maintaining a temperature of the solution at 50-60° C. for 20-30 minutes, rinsing the bobbin yarn with 40-50° C. warm water until the pH of the solution is 7, and removing moisture from the bobbin yarn with a centrifuge;

S13: drying the bobbin yarn after washing;

S14: stretching and shaping the dried bobbin yarn and stacking.

2. The method for producing a yam from sugarcane according to claim 1, wherein S2 comprises the following steps:

pre acid leaching the separated bagasse with sulfuric acid having a concentration of 0.4-1.4 ml/L, at a temperature of 30-60° C., and a soaking time of 40-75 minutes;

adding laccase in a mass ratio of 1:0.2-0.3 to the bagasse after acid leaching, and hydrolyzing for 2-6 hours at a temperature of 60-75°° C. to obtain the natural fibers;

washing the hydrolyzed natural fibers with water;

performing an alkaline reduction treatment on the natural fibers with 5-12 g/L NaOH and 5-10 g/L $H_2O_2$ to render a pH value of the natural fibers to be 6.5-7.5.

3. The method for producing a yarn from sugarcane according to claim 1, wherein S3 comprises the following steps:

soaking the bagasse in a NaOH solution with a pH of 9-11 at 25-60° C. for 1-1.25 h to obtain a solution containing starch;

filtering the solution containing starch through a 300 mesh filter and allow a filtrate to settle for 1.2-1.5 hours to obtain a starch emulsion;

washing the starch emulsion with distilled water for 6-7 consecutive times, then decolorizing and drying to obtain a sugarcane starch;

soaking the sugarcane starch in a NaOH solution with a mass percentage of 0.6%- 1.75% at 24-47° C. for 32-35 minutes, and then filtering an extracted solution through a 300 mesh filter to obtain a filter residue;

washing the filter residue twice with anhydrous ethanol and twice with acetone;

drying in a constant temperature drying oven to obtain sugarcane starch cellulose.

4. The method for producing a yarn from sugarcane according to claim 1, wherein S8 comprises the following steps:

mixing the first fibers and the second fibers to form a roving;

feeding the roving into a stretching device for stretching;

outputting strands of fiber by a front roller after stretching;

twisting by steel rings and steel wire coils, winding onto a tube that rotates with a spindle to form the bobbin yarn.

5. The method for producing a yarn from sugarcane according to claim 1, wherein S4 comprises the following steps:

preparing a softener comprising 7-12% alkylphenol ethoxylates, 6-9% sulfonic acid, 4-7.5% fatty alcohol polyoxyethylene ether, 5.6-10.3% sodium fatty alcohol ether sulfate, 7.2-12% coconut diethanolamine, 52-72% subtilase enzyme, 1-2 g/L ethylene diamine tetraacetic acid, and 6-10 g/L NaOH;

stacking the raw material of the first fibers and raw material of the second fibers after being sprayed at a temperature of 20° C.-25° C. for 16-25 hours.

* * * * *